US009637835B2

(12) United States Patent
Gao et al.

(10) Patent No.: US 9,637,835 B2
(45) Date of Patent: May 2, 2017

(54) METAL COMPOSITE AND METHOD OF PREPARING THE SAME

(71) Applicant: BYD COMPANY LIMITED, Shenzhen (CN)

(72) Inventors: Chunnan Gao, Shenzhen (CN); Liang Chen, Shenzhen (CN)

(73) Assignee: BYD COMPANY LIMITED, Shenzhen (CN)

( * ) Notice: Subject to any disclaimer, the term of this patent is extended or adjusted under 35 U.S.C. 154(b) by 0 days.

(21) Appl. No.: 14/414,412

(22) PCT Filed: Jul. 9, 2013

(86) PCT No.: PCT/CN2013/079070
§ 371 (c)(1),
(2) Date: Jan. 12, 2015

(87) PCT Pub. No.: WO2014/008852
PCT Pub. Date: Jan. 16, 2014

(65) Prior Publication Data

US 2015/0292102 A1 Oct. 15, 2015

(30) Foreign Application Priority Data

Jul. 10, 2012 (CN) ..... 2012 1 0236388

(51) Int. Cl.
*C25D 11/24* (2006.01)
*C25D 11/08* (2006.01)
*C25D 11/16* (2006.01)

(52) U.S. Cl.
CPC ..... *C25D 11/243* (2013.01); *C25D 11/08* (2013.01); *C25D 11/16* (2013.01); *C25D 11/246* (2013.01)

(58) Field of Classification Search
CPC ..... C25D 11/18; C25D 11/246; C25D 11/243
See application file for complete search history.

(56) References Cited

U.S. PATENT DOCUMENTS

| | | | | | |
|---|---|---|---|---|---|
| 3,622,472 | A * | 11/1971 | Izumikawa | C25D 11/24 | 205/221 |
| 4,444,628 | A * | 4/1984 | Furukawa | C23F 3/03 | 205/201 |
| 6,696,553 | B1 * | 2/2004 | Korte | C09B 43/11 | 106/31.44 |
| 6,797,016 | B1 * | 9/2004 | Schofberger | C09B 67/0073 | 8/506 |
| 2009/0169838 | A1 * | 7/2009 | Yamaguchi | B05D 5/06 | 428/201 |
| 2012/0015172 | A1 * | 1/2012 | Gao | C25D 11/243 | 428/304.4 |

FOREIGN PATENT DOCUMENTS

| | | | |
|---|---|---|---|
| CN | 1349551 | A | 5/2002 |
| CN | 101768770 | A | 7/2010 |
| CN | 102407702 | A * | 4/2012 |
| JP | 5698494 | A | 8/1981 |
| JP | 2010037604 | A * | 2/2010 |
| JP | 2010270351 | A | 12/2010 |

* cited by examiner

*Primary Examiner* — Louis Rufo
(74) *Attorney, Agent, or Firm* — Anova Law Group, PLLC

(57) ABSTRACT

A method of preparing a metal composite, comprising the steps of: forming an anodic oxidation layer on a surface of a metal substrate; forming a dye layer comprising a dye and a water soluble ink on the anodic oxidation layer, wherein the dye layer has a graduated thickness; and removing the water soluble ink.

14 Claims, No Drawings

METAL COMPOSITE AND METHOD OF PREPARING THE SAME

CROSS REFERENCE TO RELATED APPLICATION

This application is a national phase entry under 35 U.S.C. X371 of International Application No. PCT/CN2013/079070, filed on Jul. 9, 2013, which claims the priority to and benefits of Chinese Patent Application Serial No. 201210236388.6, filed with the State Intellectual Property Office of P. R. China on Jul. 10, 2012, the entire contents of which are incorporated herein by reference.

FIELD

The present disclosure relates to surface treatments and, more particularly, to a metal composite, and methods of preparing the same.

BACKGROUND

The statements in this section merely provide background information related to the present disclosure and may not constitute prior art.

Currently, in the field of metal surface decoration, a gradient color is mainly obtained by coating or printing dyes directly on the surface of a metal work-piece. However, a conventional surface decoration layer is usually a paint film. The paint film has a poor bonding ability with metals, thus the paint film peels easily. In addition, the paint film has a low hardness; therefore, the paint film may be worn and scratched easily.

Therefore, a method for decorating a metal surface is proposed, that is, treating a metal substrate having an anodic oxidation layer with dyes, in which dye molecules penetrate into micropores of the anodic oxidation layer. The dyed metal substrate has a surface different from the paint film, thus the dyed metal substrate having the anodic oxidation layer has a better metal texture and better surface properties. However, the color-gradience obtained is simple and lack of variety, i.e., the dye surface shows only a simple one-direction "linear" color-gradience, such as one color changing from dark to light or from light to dark, or a color changing to another different color.

SUMMARY

This summary is provided to introduce a selection of concepts in a simplified form that are further described below in the DETAILED DESCRIPTION. This summary is not intended to identify key features or essential features of the claimed subject matter, nor is it intended to be used as an aid in determining the scope of the claimed subject matter.

The present invention seeks to solve at least one of the problems existing in the prior art to at least some extent. To this end, an objective of the present invention is to provide a method for preparing a metal composite. The method may comprise the steps of: forming an anodic oxidation layer on a surface of a metal substrate; forming a dye layer comprising a dye and a water soluble ink on the anodic oxidation layer, wherein the dye layer has a gradual thickness; and removing the water soluble ink.

Another objective of the present invention is to provide a metal composite. The metal composite may be prepared by a method according to any method mentioned above.

With the method for preparing the metal composite according to embodiments of the present disclosure, by means of applying the dye solution (comprising the dye and the water soluble ink) on the anodic oxidation layer of the metal substrate, the dye can penetrate and be absorbed into micropores of the anodic oxidation layer, while the water soluble ink may stay on surface of the anodic oxidation layer. After removing the water soluble ink, as the dye layer has different thicknesses at different regions of the anodic oxidation layer (the amounts of dye absorbed into the micropores at different site of the anodic oxidation layer may be different), a metal composite having a gradient color may be obtained. According to an embodiment of the present disclosure, the amount of dye solution that applied on the anodic oxidation layer may be different, thereby the amount of dye which is absorbed into micropores at different regions of the anodic oxidation layer may be different accordingly; thus the obtained metal composite can present a gradient color.

In some embodiments, more than one dye solution which contain dyes having different colors may be applied on the anodic oxidation layer. Alternatively, one dye solution which contains dyes having different colors may be applied on the anodic oxidation layer, thus obtained metal composite may present a color-gradience between two colors or among more colors.

As described above, with the method for preparing the metal composite according to embodiments of the present disclosure, by controlling the method of applying the dye solution (such as, an applying equipment, an operation condition, amount or types of the dye solution, etc.), the metal composite may obtain a variety of color-gradiences on the surface, such as linear color-gradience, radial color-gradience, diamond color-gradience, and so on, which may greatly improve the decoration effect for the metal surface.

Additional aspects and advantages of embodiments of present disclosure will be given in part in the following descriptions, become apparent in part from the following descriptions, or be learned from the practice of the embodiments of the present disclosure.

DETAILED DESCRIPTION

Reference will be made in detail to embodiments of the present disclosure. The embodiments described herein are explanatory, illustrative, and used to generally understand the present disclosure. The embodiments shall not be construed to limit the present disclosure.

According to a first aspect of the present disclosure, there is provided a method of preparing a metal composite. The method may comprise the steps of: forming an anodic oxidation layer on a surface of a metal substrate; forming a dye layer comprising a dye and a water soluble ink on the anodic oxidation layer, in which the dye layer has a gradual thickness; and removing the water soluble ink.

There are no special limits for the metal substrate; any common metal substrate which is capable of being anodized to form an anodic oxidation layer on a surface thereof can be used. In some embodiments, according to the present disclosure, the metal substrate comprises Al or Al alloy.

In an embodiment according to the present disclosure, prior to the step of forming the anodic oxidation layer, the metal substrate may be subjected to a pretreatment. For different metal substrates, the pretreatment can be selected from any appropriate methods in the art. For example, for a metal substrate which is Al or Al alloy, the pretreatment usually comprises: removing paraffin and oil, alkali corrosion, first neutralizing, chemical polishing, second neutralizing and washing, etc.

The anodic oxidation layer can be formed by any appropriate method in the art. In some embodiments of the present disclosure, the anodic oxidation layer is formed by an anodic oxidation treatment. Generally, the anodic oxidation treatment is performed by using a metal work-piece as an anode, an electrolytic bath solution as the cathode; and anodizing the metal work-piece in an electrolyte solution. In an embodiment, the electrolyte solution may be at least one of: sulfuric acid, chromic acid, and oxalic acid. In some embodiments, the anodic oxidation layer is formed by immersing the metal substrate in a sulfuric acid solution having a concentration of about 150 g/L to about 210 g/L for about 10 minutes to about 60 minutes under a voltage of about 5 Volts to about 20 Volts. Therefore the metal substrate including an anodic oxidation layer is obtained. In that way, the anodic oxidation layer may have a thickness of about 5 microns to about 20 microns, and the anodic oxidation layer may have larger porosity, better corrosion resistance and wear resistance than those from other methods.

In some embodiments of the present disclosure, the step of forming the dye layer is performed by spraying a dye solution comprising the dye and the water soluble ink on the anodic oxidation layer; and the dye layer has a gradual thickness. By way of example and without limiting, the position of each region or point at the dye layer can be referred as a coordinate (X, Y), and the gradual thickness Z may be represented with a function Z=f(X, Y), in which Z refers to a thickness at a region/point (X, Y) of the dye layer and the function is a continuous function.

When a dye liquid (not containing water soluble ink) is sprayed on the metal substrate (such as the anodic oxidation layer formed on the metal substrate) directly, a solution film formed may have a consistent thickness due to a flow leveling effect. That is, a content of the dye applied on different portions of the metal substrate may be consistent, thus failing to realize a gradient color.

According to an embodiment of the present disclosure, when the dye solution comprising the dye and the water soluble ink is sprayed on the anodic oxidation layer of the metal substrate, the dye solution may be adhered thereto to form a dye layer, and a thickness of the dye layer at different portions of the anodic oxidation layer may keep stable. Therefore a dye layer having a gradual thickness could be obtained and maintained (where different portions at the anodic oxidation layer have different thicknesses). In some embodiments, after resting for a predetermined time period, the dyes in the dye layer may go downwardly to adhere in micropores of the anodic oxidation layer completely.

In the present disclosure, as the water soluble ink has a lower flowability or fluidity than other dye liquid, when the dye solution containing the water soluble ink is coated on a surface of a metal substrate (such as the anodic oxidation layer formed on the surface of the metal substrate), the dye solution may not spread or flow leveling, and the dye layer thus formed may keep the thickness at different portions to be unchanged (stable). Further, the dye comprises an anionic group, such as —SO3H and —COOH, which may form a chemical absorption and physical absorption with the anodic oxidation layer. Therefore, the dye in the dye layer may be absorbed by the micropores of the anodic oxidation layer easily. Moreover, after the dye has been absorbed into the anodic oxidation layer, the water soluble ink remained could be removed by a simple washing step, in which the water soluble ink is removed while the dye remains adhered in the micropores. As the prior dye layer has different thickness at different sites thereof, i.e., the amount of dye solution sprayed on different regions/points at the anodic oxidation layer is different, the amount of dye remained in the micropores at different regions/points of the anodic oxidation layer is different. After the water soluble ink has been removed, the difference in the amount of dye remained in the micropores at different regions/points of the anodic oxidation layer provides the dyed metal substrate with a gradient color.

There are no special limitations for the water soluble ink, the water soluble ink could be any appropriate water soluble ink. In some embodiments of the present disclosure, the water soluble ink comprises one or more selected from a group consisting of alcohols, short-chain oils, and ketones. Generally, a water soluble ink comprising alcohols is also named as alcohol-type water soluble ink, which contains alcohols as a solvent, such as a water soluble ink whose solvent is propyl alcohol or butyl alcohol; a water soluble ink comprising short-chain oils is a water soluble ink including short-chain oils as a solvent, such as a water soluble ink whose solvent is glycerol; a water soluble ink comprising ketones is a water soluble ink including ketones as a solvent, such as a water soluble ink whose solvent is acetone or butanone.

In some embodiments of the present disclosure, the dye solution mainly comprises a dye and a water soluble ink. In some embodiments of the present disclosure, based on the weight of the dye solution, the dye has a concentration of about 10 wt % to about 20 wt %. In that way, the dye may be absorbed into micropores of the anodic oxidation layer more easily.

In one embodiment of the present disclosure, the dye comprises at least one selected from a group consisting of azos, benzoquinones, nitro compounds, and cyanines. The detailed descriptions of an azo-dye, a benzoquinone-dye, a nitro compound-dye, and a cyanine-dye are omitted herein. In some embodiments, the anodic oxidation layer is electropositive, and the dye comprises anionic groups such as —SO3H and —COOH, thus there may be a chemical absorption and a physical absorption effect between the dye and the anodic oxidation layer, therefore the dye will be absorbed into the micropores of the anodic oxidation layer.

In some embodiments of the present disclosure, the method further comprises a step of: resting the metal substrate formed with the dye layer for about 1 minute to about 30 minutes prior to the step of removing the water soluble ink. In that way, the dye may go downwardly and be absorbed into the micropores of the anodic oxidation layer more completely.

In the step of spraying the dye solution comprising the dye and the water soluble ink on the surface of the metal substrate (for example, the anodic oxidation layer on the surface of the metal substrate), the thickness of the dye layer (i.e. the amount of the dye solution be sprayed) could be adjusted according to required color gradience effect, shape or pattern. For example, when a gradient effect of a color changing from light to dark is required, where the thickness of the dye layer needs to be increased gradually, therefore the amount of the dye (corresponding with the amount of the dye solution) which is absorbed into micropores of the anodic oxidation layer is adjusted to be increased gradually. Similarly, when a gradient effect of a color changing from dark to light is required, where the thickness of the dye layer needs to be decreased gradually, therefore the amount of dye which is absorbed into micropores of the anodic oxidation layer is adjusted to be decreased gradually.

In some embodiments, spraying the dye solution on the anodic oxidation layer may be carried out with a spraying equipment, such as an automatic spraying equipment, which comprises two guide rails located in the lateral and longitudinal directions, two spray guns located on the two guide rails, and a motor driving the guide rails via computer programs. The spray gun could realize a uniformly or uniformly accelerated movement in a straight line, a circular path, or a rectangular path. Meanwhile, the amount of the dye solution sprayed onto the anodic oxidation layer could also be controlled to form dye layers having graduated thicknesses and different shapes. By means of changing the type of available colors in the dye solution, the color-gradience can comprise multiple colors. In some embodiments of the present disclosure, the spraying nozzle of the spray gun has a diameter of about 0.1 millimeter to about 0.3 millimeter, so that the color-gradience may be more natural.

With the method for preparing the metal composite according to embodiments of the present disclosure, different kinds of color-gradiences, such as a color-gradience of one single color, double color-gradience between two colors and color-gradience of multiple colors, can be obtained by controlling the spraying equipment, spraying condition, dye solution, etc. The color-gradience is mainly obtained by controlling the amount of the dye solution sprayed onto the anodic oxidation layer (i.e. the thickness at different regions of the dye layer). Where the dye layer is thicker, the amount of the dye at this region is relatively larger and, accordingly, the amount of the dye absorbed into the anodic oxidation layer can also be relatively larger. Thus, the color obtained at this region of the anodic oxidation layer can be denser or darker. On the other hand, when the dye layer is thinner, the amount of the dye in the dye layer is small and, accordingly, the amount of the dye absorbed into the anodic oxidation layer can be relatively less. Thus, the color obtained at this region of the anodic oxidation layer can be less dense or lighter. When spraying a dye solution comprising two or more kinds of dyes (each having a color different with each other) on the surface of the metal substrate (such as the anodic oxidation layer formed on the metal substrate) or, alternatively, spraying two or more dye solution each comprising a dye having a color different with each other, a color-gradience between two colors or among more colors can be obtained. In addition, under control of computer programs, dye patterns or structures having different shapes can be formed on the anodic oxidation layer.

In some embodiments of the present disclosure, the method further comprises a step of washing and drying the metal substrate prior to the step of forming the dye layer. The method of drying the metal substrate is not limited by using a clean compressed air to blow, or using an oven. Other methods which are capable of performing the drying may also be applied. In some embodiments of the present disclosure, drying the metal substrate is carried out in an oven, at a temperature of about 40° C. to about 100° C. until there are no apparent water drops on the metal substrate. With that washing and drying steps, a compatibility between the dye layer and the anodic oxidation layer may be improved, which is useful for the contact between the dye layer and the anodic oxidation layer, as well as the following steps.

In some embodiments of the present disclosure, because the water soluble ink is water soluble, after the dye has been absorbed into the anodic oxidation layer, the remaining water soluble ink can be removed by a simple water-washing step. In some embodiments of the present disclosure, the method further comprises a step of sealing holes (for example, the micropores mentioned above) of the metal substrate after removing the water soluble ink. There are no special limitations on the method for sealing holes, and the method of sealing holes may be any appropriate sealing method. For example, in one embodiment of the present disclosure, the step of sealing holes is performed by using a sealing agent. There are no special limitations on the sealing agent, and the sealing agent can be any appropriate sealing agent. In one embodiment of the present disclosure, the sealing agent includes a nickel sealing agent, preferably nickel acetate. The sealing solution may comprises a sealing agent having a concentration of about 6 g/L to about 10 g/L and a temperature of about 95° C. to about 98° C. The time for sealing holes may be about 15 minutes to about 40 minutes.

A metal composite prepared according to the method mentioned above is also provided in the present disclosure.

With the methods of preparing the metal composite according to embodiments of the present disclosure, by means of applying the dye solution (comprising the dye and the water soluble ink) on the anodic oxidation layer of the metal substrate, the dye solution may penetrate and be absorbed into micropores of the anodic oxidation layer, and the dye may go downwardly onto the bottom of the micropores with the water soluble ink in the upper portion of the micropores during the subsequent resting step. After removing the water soluble ink, as the remaining dye has different thicknesses at different regions of the anodic oxidation layer (the amounts of remaining dye at different regions of the anodic oxidation layer are different), a metal composite having a gradient color can be obtained. According to an embodiment of the present disclosure, an amount of dye solution that applied on the anodic oxidation layer may be different, thereby the amount of dye absorbed into micropores at different regions of the anodic oxidation layer may be different accordingly. Thus, the obtained metal composite may present a gradient color.

In some embodiments, more than one dye solution which contains dyes having different colors may be applied on the anodic oxidation layer or, alternatively, one dye solution which contains dyes having different colors may be applied on the anodic oxidation layer. Thus, the obtained metal composite may present a color-gradience between two colors or among more colors.

As described above, with the methods for preparing the metal composite according to embodiments of the present disclosure, by controlling the method of applying the dye solution (such as, an applying equipment, an operation condition, amount or types of the dye solution, etc.), the metal composite may obtain a variety of color-gradiences on the surface, such as linear color-gradience, radial color-gradience, diamond-shaped color-gradience, and so on, which may greatly improve the decoration effect for the metal surface.

The disclosure will be further described below in way of examples. Raw materials used in Examples and Comparative Examples are all commercially available.

Example 1

An Al substrate was immersed in a degreasing powder having a concentration of 50 g/L at 60±10° C. for 4 minutes. Then the Al substrate subjected to the degreasing powder was alkali-etched with a NaOH solution having a concentration of 60 g/L at 70±10° C. for 15 seconds. Next, the Al substrate was neutralized with a 40% HNO3 solution, and then removed from the HNO3 solution and cleaned.

Further, the Al substrate was anodized in a H2SO4 solution having a concentration of 180 g/L and an aluminum ion concentration of 6 g/L for 40 minutes under a voltage of 15 Volts and a temperature of 19-20° C.

A dye solution comprising a blue dye No. 419 (produced by OKUNO CHEMICAL INDUSTRIES CO., LTD (Japanese)) and a water soluble ink was sprayed on the anodized surface of the Al substrate using an automatic spraying instrument, in which, based on the total weight of the dye solution, the dye had a concentration of 10 wt %. After the Al substrate was rested for 15 minutes, the Al substrate was washed with water completely.

Then, the Al substrate was immersed in an 8 g/L Top seal DX-500 (commercially available from OKUNO CHEMICAL INDUSTRIES CO., LTD (Japanese)) solution for 30 minutes in order to seal holes, and removed from the solution, washed with water, and dried. A metal composite having a gradient pattern formed on the anodized surface of the Al substrate was obtained.

The metal composite has a single color-gradience in the radial direction. It can be observed that, the gradation pattern is continuous and clear.

Example 2

An Al substrate was immersed in a degreasing powder having a concentration of 50 g/L at 60±10° C. for 4 minutes. Then the Al substrate subjected to the degreasing powder was alkali-etched with a NaOH solution having a concentration of 60 g/L at 70±10° C. for 15 seconds. Next, the Al substrate was neutralized with a 40% HNO3 solution, and then removed from the HNO3 solution and cleaned.

Further, the Al substrate was anodized in a H2SO4 solution having a concentration of 160 g/L and an aluminum ion concentration of 5 g/L for 35 minutes under a voltage of 13 Volts and a temperature of 19-20° C.

A dye solution comprising a red dye No. 102 (produced by OKUNO CHEMICAL INDUSTRIES CO., LTD (Japanese)) and a water soluble ink was sprayed on the anodized surface of the Al substrate using an automatic spraying instrument, in which based on the total weight of the dye solution, the dye had a concentration of 15 wt %. After the Al substrate was rested for 15 minutes, the Al substrate was washed with water completely.

Then, the Al substrate was immersed in an 8 g/L Top seal DX-500 (commercially available from OKUNO CHEMICAL INDUSTRIES CO., LTD (Japanese)) solution for 30 minutes in order to seal holes, and removed from the solution, washed with water, and dried. A metal composite having a gradient pattern formed on the anodized surface of the Al substrate was obtained.

The metal composite has a single color-gradience in the radial direction. It can be observed that, the gradation pattern is continuous and clear.

Example 3

An Al substrate was immersed in a degreasing powder having a concentration of 50 g/L at 60±10° C. for 4 minutes. Then the Al substrate subjected to the degreasing powder was alkali-etched with a NaOH solution having a concentration of 60 g/L at 70±10° C. for 15 seconds. Next, the Al substrate was neutralized with a 40% HNO3 solution, and then removed from the HNO3 solution and cleaned.

Further, the Al substrate was anodized in a H2SO4 solution having a concentration of 200 g/L and an aluminum ion concentration of 10 g/L for 30 minutes under a voltage of 16 Volts and a temperature of 19-20° C.

The anodized metal substrate was washed with water, and dried in an oven for 6 minutes at a temperature of 85° C.

A dye solution comprising a green dye No. Green GM (produced by OKUNO CHEMICAL INDUSTRIES CO., LTD (Japanese)) and a water soluble ink was sprayed on the anodized surface of the Al substrate using an automatic spraying instrument, in which based on the total weight of the dye solution, the dye had a concentration of 20 wt %. After the Al substrate was rested for 25 minutes, the Al substrate was washed with water completely.

Then, the Al substrate was immersed in an 8 g/L Top seal DX-500 (commercially available from OKUNO CHEMICAL INDUSTRIES CO., LTD (Japanese)) solution for 30 minutes in order to seal holes, and removed from the solution, washed with water, and dried. A metal composite having a gradient pattern formed on the anodized surface of the Al substrate was obtained.

The metal composite has a single color-gradience in the radial direction. It can be observed that, the gradation pattern is continuous and clear.

Although explanatory embodiments have been shown and described, it would be appreciated by those skilled in the art that the above embodiments cannot be construed to limit the present disclosure, and changes, alternatives, and modifications can be made in the embodiments without departing from spirit, principles and scope of the present disclosure.

What is claimed is:

1. A method of preparing a metal composite on a metal substrate, comprising:

forming an anodic oxidation layer on a surface of the metal substrate to contain a plurality of micropores within the anodic oxidation layer;

forming a dye layer comprising a dye and a water soluble ink on the anodic oxidation layer, wherein:

the dye layer has a gradual thickness that is represented by a two dimensional continuous function, and the water soluble ink has a low fluidity to resist a flow leveling effect and maintains the gradual thickness of the dye layer, such that the maintained gradual thickness is kept stable, and different thicknesses and shapes of the dye layer at different portions of the anodic oxidation layer for forming a corresponding gradient color pattern are unchanged during an entire subsequent resting process;

resting the metal substrate such that an amount of the dye goes downwardly from the stable dye layer on the anodic oxidation layer, to be separated with the water soluble ink, and to be absorbed into the micropores within the anodic oxidation layer, wherein the amount of the dye changes with the unchanged gradual thickness of the dye layer to form the corresponding gradient color pattern on the metal composite; and removing the water soluble ink that is remained on the anodic oxidation layer.

2. The method of claim 1, wherein the step of forming the dye layer is performed by spraying a dye solution comprising the dye and the water soluble ink on the anodic oxidation layer.

3. The method of claim 1, wherein the step of removing the water soluble ink is performed by washing with water.

4. The method of claim 1, wherein the step of resting the metal substrate is performed for about 1 minute to about 30 minutes prior to the step of removing the water soluble ink.

5. The method of claim 1, further comprising a step of sealing holes of the metal substrate after removing the water soluble ink.

6. The method of claim 2, wherein based on the weight of the dye solution, the dye has a concentration of about 10 wt % to about 20 wt %.

7. The method of claim 2, wherein the dye comprises at least one selected from a group consisting of azos, benzoquinones, nitro compounds, and cyanines.

8. The method of claim 1, wherein the water soluble ink comprises at least one selected from a group consisting of alcohols, short-chain oils, and ketones.

9. The method of claim 8, wherein the water soluble ink comprises at least one selected from a group consisting of propyl alcohol, butyl alcohol, glycerol, acetone, and butanone.

10. The method of claim 1, wherein the anodic oxidation layer is formed by immersing the metal substrate in a sulfuric acid solution having a concentration of about 150 g/L to about 210 g/L for about 10 minutes to about 60 minutes under a voltage of about 5 Volts to about 20 Volts.

11. The method of claim 1, further comprising a step of washing and drying the metal substrate prior to the step of forming the dye layer.

12. The method of claim 5, wherein the step of sealing holes is performed by using a nickel sealing agent.

13. The method of claim 1, wherein the metal substrate comprises Al or Al alloy.

14. The method of claim 1, wherein the anodic oxidation layer has a thickness of 5 microns to 20 microns.

* * * * *